US006080258A

United States Patent [19]

Tittgemeyer

[11] Patent Number: 6,080,258

[45] Date of Patent: Jun. 27, 2000

[54] METHOD FOR PRODUCING CYLINDRICAL COATING CARRIERS

[75] Inventor: Udo Tittgemeyer, Arnsberg, Germany

[73] Assignee: Heidelberger Druckmaschinen AG, Heidelberg, Germany

[21] Appl. No.: 09/071,700

[22] Filed: May 1, 1998

[30] Foreign Application Priority Data

May 16, 1997 [DE] Germany ..... 197 20 549

[51] Int. Cl.[7] ..... B65H 81/00

[52] U.S. Cl. ..... 156/192; 156/191; 156/195; 156/281

[58] Field of Search ..... 156/169, 173, 156/175, 195, 191, 192, 161, 281

[56] References Cited

U.S. PATENT DOCUMENTS

| | | | |
|---|---|---|---|
| 3,148,102 | 9/1964 | Eakins et al. | 156/173 X |
| 3,617,414 | 11/1971 | Wesch | 156/175 X |
| 4,387,498 | 6/1983 | Morhard | 156/195 X |
| 4,514,245 | 4/1985 | Charbier | 156/161 |
| 5,266,139 | 11/1993 | Yokota et al. | 156/175 X |
| 5,316,798 | 5/1994 | Tittgemeyer . | |
| 5,323,702 | 6/1994 | Vrotacoe et al. . | |
| 5,379,693 | 1/1995 | Hoffman et al. . | |
| 5,429,048 | 7/1995 | Gaffney et al. . | |

FOREIGN PATENT DOCUMENTS

| | | |
|---|---|---|
| 0 421 145 | 4/1991 | European Pat. Off. . |
| 0 715 966 | 6/1996 | European Pat. Off. . |
| 2 188 501 | 1/1974 | France . |
| 39 08 999 | 3/1993 | Germany . |
| 41 40 768 | 8/1994 | Germany . |
| 42 30 431 | 9/1996 | Germany . |

*Primary Examiner*—Jeff H. Aftergut
*Attorney, Agent, or Firm*—Kenyon & Kenyon

[57] ABSTRACT

A method for winding a continuous material onto a supporting surface, the method being characterized more precisely by the following process steps:

unwinding a material (6) from a material supply (7) and winding said material onto a supporting surface (5);

the pendulum-type support (17) of the material (6,7) during the advance, permitting an automatic adjustment of a winding angle α;

maintaining the tensile stress during the winding of the material (6);

the cleaning and conditioning pretreatment of the material (6) carried out between unwinding and winding; and the coating with adhesive carried out between unwinding and winding.

22 Claims, 4 Drawing Sheets

METHOD FOR PRODUCING CYLINDRICAL COATING CARRIERS

FIELD OF THE INVENTION

The present invention relates to a method for producing round, metallic sleeves as coating carriers upon which functionally specific coatings can be applied subsequently, such coatings including multilayer coatings such as compressible coatings for offset printing.

RELATED TECHNOLOGY

German patent 41 40 768 C2 discloses a method for producing an offset printing form from a metallic material for a form cylinder of a printing machine. First of all, a plate is cut to the dimensions corresponding to the circumference and width of the form cylinder, and is provided with register devices at at least one end face. The plate-shaped blank is subsequently coated and exposed to light in a manner conventional for producing printing forms, whereupon the rectangular plate is forced by bending into a hollow cylindrical shape in a welding device and is clamped there, so as to retain the register. The plate edges allocated to one another are welded together, forming a longitudinal seam, the welding process being carried out in such a way that a welding seam is formed which has a concave shape on the upper and lower sides. Besides the coating and irradiation of the plate-shaped blank, the printing form resulting from it can be coated and irradiated on the form cylinder.

This manufacturing method is disadvantageous in that the total length of the plate-shaped blank, which is later supposed to yield the diameter, must be cut to size in an exactly parallel manner and with a suitably high accuracy of perceptibly better than 1/10 mm. Furthermore, the introduction of heat during the welding process causes a longitudinal stretch of the material in the area of the welding seam. This elongation leads to a waviness on both sides along the welding seam. When using a sleeve produced in such a manner, this unavoidable waviness in the seam area leads to the appearance of air pockets which, in response to outer pressure on the sleeve, wander under said sleeve, causing the sleeve to twist on the cylinder. This necessitates an additional procedure for the subsequent calibration of such sleeves produced according to this method.

German patent 39 08 999 C2 discloses a cylinder body and a method for coating said cylindrical body. It is proposed to provide a cylindrical body with a seamless coating in such a way that a thixotropic multicomponent material, in the form of a flowing-type foam mixed with expanding agents and inhibitors, is applied as coating material in more or less a spiral form on the cylindrical body during rotation and advance motion. Metallic aluminum or a plastic reinforced with carbon fibers is used as sleeve material. However, the use of plastic sleeves also has disadvantages. For example, in view of the considerably lower modulus of elasticity, they must be manufactured with greater wall thickness in order to attain seating stability comparable to metallic sleeves. Great wall thicknesses, which for example are exposed to higher temperature during the application of functional layers to be processed with heat, are temperature-sensitive. This can lead to the loss of dimensional accuracy and to the build-up of high internal tensions.

Sleeve-shaped rubber blankets have been disclosed by EP 0 421 145 A2 and EP 0 715 966 A1 which can be laterally forced onto blanket cylinders of rotary presses. The rubber coating is applied on nickel sleeves. The nickel sleeves are produced by galvanic means. A thin nickel skin is deposited on a master cylinder which is lowered into the nickel bath, the nickel skin later being milled after reaching the necessary wall thickness of the master cylinder. Producing nickel sleeves in this way results in an increased power requirement and is extremely time-consuming.

SUMMARY OF THE INVENTION

An object underlying the present invention is to provide a manufacturing method for cylindrical coating carrier sleeves which avoids the disadvantages of the known design approaches.

Thus, a goal of the development underlying the present invention is to economically produce coating carrier sleeves the way diverse types of tubes have already been produced for a long time in great quantities, such as cardboard tubes which are wound from paper layers, or plastic tubes which are likewise wound from coiled stock.

Since, however, in the case of the printing industry, extremely high accuracies, great stiffness and high stability are conditions for the use of such tubes, as already explained before, only metallic tape is primarily considered as tape material in the present application.

In this context, however, the known methods of tube winding are not transferable, which is why to the best of present knowledge there have been no such tubes, in spite of the advantage to be expected. The problems, from the standpoint of process engineering, of winding tubes from metallic tape are multiple.

In order to bond metals reliably, as is known, a thorough cleaning and a jet-blast process for enlarging the contact surface is needed to provide a better metal-adhesive bond. In the case of the present application, neither of the two procedures suffices. Metallic tapes have on them a "rolling skin"; this is essentially grease rolled in with high compression. This grease-metal combination prevents any reliable bonding. However, treatment with jet-blast processes, such as sand blasting, deforms the thin tape material too strongly.

The demanded accuracy and stiffness make it necessary for the tape windings to adjoin one another precisely, abutting surface to abutting surface. To achieve that, a highly precise winding angle, a very exact, uniform web tension, and a precise, plane-parallel tape position relative to the winding surface are necessary.

The tape ends, ending in a point, of each lower tape position turn out to be another serious problem during the length-wise trimming of the pre-wound tubes. The points result due to the axially offset position of the tape with respect to the cylinder, the spiral shape. The adhesive bond of the theoretically infinitely tapering tape ends is no match for a normal cutting pressure.

The present invention therefore provides a method for winding a continuous material onto a supporting surface, the method being characterized more precisely by the following process steps:

unwinding a material (6) from a material supply (7) and winding said material onto a supporting surface (5);

the pendulum-type support (17) of the material (6,7) during the advance, permitting an automatic adjustment of a winding angle $\alpha$;

maintaining the tensile stress during the winding of the material (6);

the cleaning and conditioning pretreatment of the material (6) carried out between unwinding and winding; and the coating with adhesive carried out between unwinding and winding.

The advantages attainable by the method of the present invention are of a diverse nature.

The design approach according to the present invention also allows an integrated pretreatment of the tape material, which is provided in the shape of a coil, inclusive of the operations actually introduced before the unwinding. The tape material can be hung in the pendulum-type support and the necessary cleaning and conditioning of the tape is carried out during the unwinding of the tape material. Producing a pre-tension in the tape material allows high precision of the winding operation, with the most precise formation of abutting surfaces. The pendulum-type support of the tape material makes it possible to dispense with the stipulation of a winding angle—rather, it adjusts automatically.

Further refinements of the idea underlying the present invention are to clean the tape material continuously during the unwinding process. For example, the degreasing and removal of dust can be carried out electrolytically. In an appropriately designed cleaning station, the tape material can also be slightly etched under polarity reversal. This produces a micro-roughness of the tape-material surface, so that excellent adhesive results can be attained in subsequent process steps of the method according to the present invention.

After the tape material has been cleaned, it is dried in a drying station. Thereupon, the tape material can be conditioned. Meant by conditioning in the present context is a surface treatment of the tape material, for instance a surface treatment with a primer. For example, the surface adherence of the adhesive agent to the tape material can be improved through the surface application of a primer, given simultaneous tape cleaning. In place of the primer, the adhesive bond can be further improved by enriching the surface of the tape material with non-ferrous ions such as copper ions. These enrichments are lacking, however, in highly alloyed steels and high-grade steels. They considerably improve not only the hardening of anaerobic adhesive systems, but above all the metal-adhesive bond. The tape material can be enriched with ions by brushing the tape material with copper or brass brushes; a primer application would also be conceivable for the copper-ion enrichment.

According to the present method, after the one side of the tape material is treated, it is turned around so that its remaining side can also be cleaned and further pretreated. To that end, a cleaning station, drying and further pretreatment are provided correspondingly for this side of the tape material as well.

Trimming devices are allocated to the supporting surface of the winding cylinder for trimming the edges of the wound sleeves. These trimming devices can be cutting tools such as milling cutters, for example, or can also be designed as optical devices such as lasers. If lasers are provided as trimming devices, the edge of the layers can be simultaneously trimmed and welded together all-around.

The pre-tension of the tape material is maintained by a pull and braking roller, arranged in the conveying path of the tape material, around which the tape material is looped over a relatively large peripheral area. The adhesive, for example an anaerobic adhesive system, is then applied to one side of such a type of pre-tensioned tape material.

A device for implementing the present method provides for constructing the housing or support wall for the pretreatment stations, the support of the material spool, the pull and braking roller, as well as the adhesive-application station so as to allow a pendulum motion relative to the winding cylinder, so that through their advance motion and the winding speed, a self-adjustment of the winding angle results.

BRIEF DESCRIPTION OF THE DRAWINGS

In the following, the present invention is explained in more detail with the aid of the drawings, in which.

DETAILED DESCRIPTION

Figure 1:
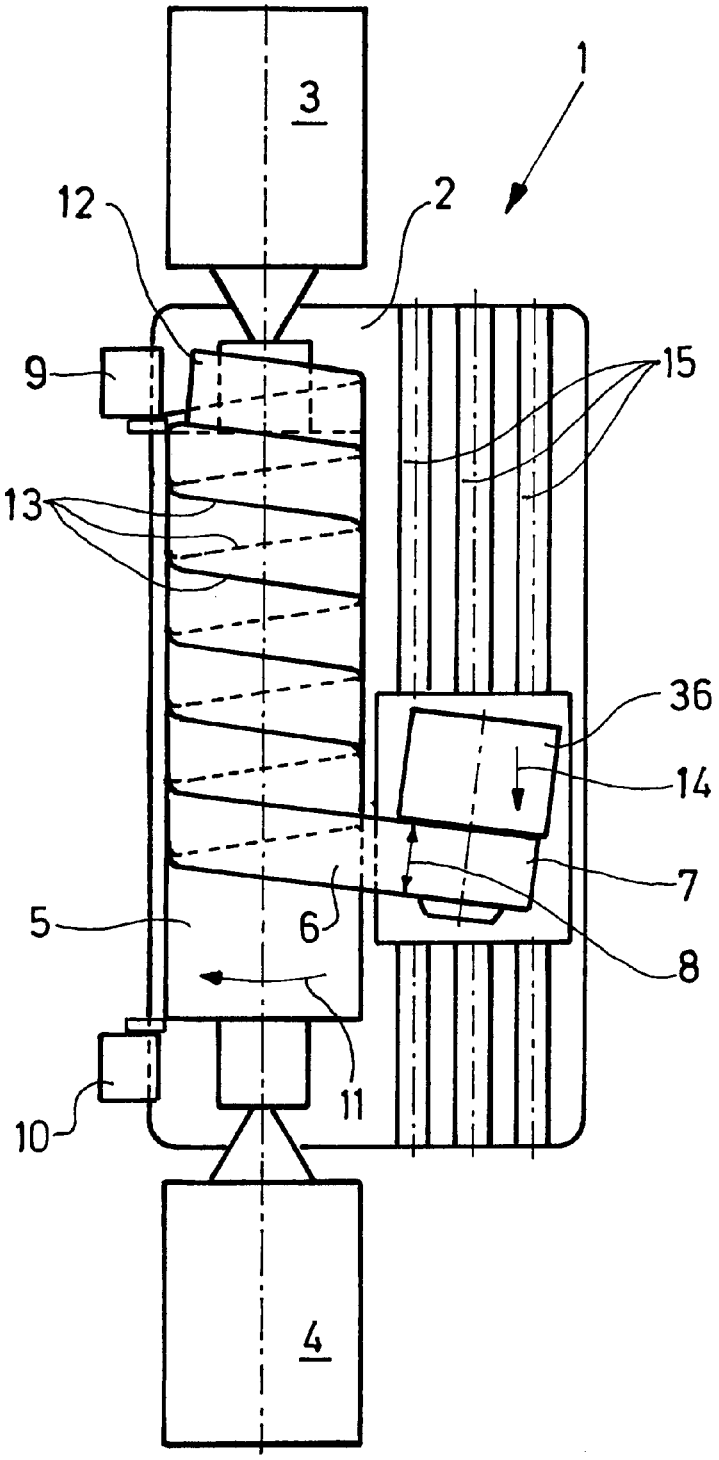
FIG. 1 shows a top view of a schematically sketched winding station.
Figure 4:
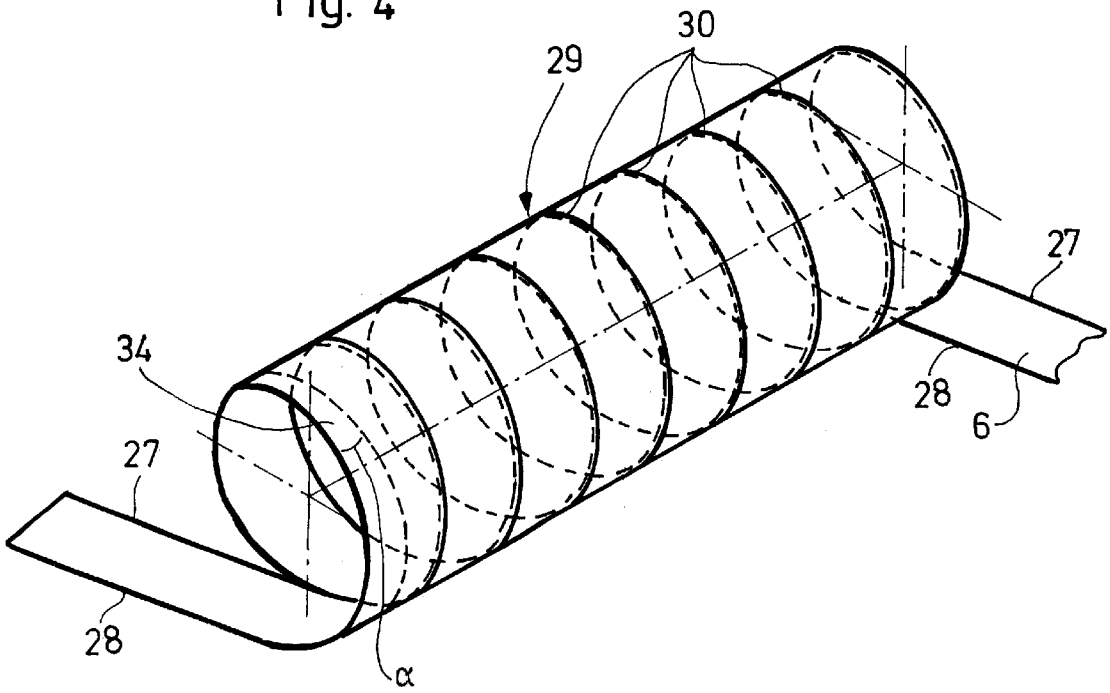
FIG. 4 shows a base winding composed of a first winding layer.

FIG. 1 is a representation of a winding station 1, sketched here only schematically. Winding station 1 comprises a winding cylinder 5 which is rotationally mounted on both sides in two tailstocks 3,4. In this top view, underneath winding cylinder 5, machine frame 2 can be recognized, on which a material spool 7 is arranged in a manner that it can be withdrawn, said spool feeding a narrow tape material 6 having a width 8. It is discernible that material spool 7, which is supported in a manner allowing pendulum motion, is aligned in a winding angle with respect to winding cylinder 5. This alignment takes place automatically by stipulation of the winding angle during the advance of material spool 7 in the advance direction 14. The tape 6 begins winding on the cylinder 5 at a start 12 and as it is wound around the cylinder 5, sides 13 abut each other. (As shown in FIG. 4, during the winding operation, a first layer 29 of tape material 6 forms on winding cylinder 5, the windings of layer 29 abutting on one another, without gaps and without overlapping, at abutting surfaces 30.) Devices 9,10 for trimming the edges of the winding layers are allocated to the end faces of winding cylinder 5. They can be milling devices, or even optical devices such as lasers, for instance, with whose aid the end-face areas of the sleeve layers to be wound are able to be pre-trimmed. In using lasers at the end faces, for example, the resulting tape point could be fixed in position. In addition to fixing the tapering point of the tape in position, the entire edge can also be trimmed simultaneously and welded all-around by the lasers. Thus, the end faces of the single-layer or multilayer sleeve of tape material can be stiffened at the same time and better safeguarded against unintentional damage.

To maintain a constant pre-tension of tape material 6, a stepping motor 36, with whose help tape material 6 is held under pre-tension, can be mounted at winding spool 7. Winding cylinder 5 rotates in winding direction 11 and constantly unwinds narrow tape material 6, contained on material spool 7, from said material spool 7. It should just be mentioned that on machine frame 2, there are guideways 15 in which tape material supply 7 to be wound can be carried along parallel to the axis of winding cylinder 5 during the advance when winding.

Figure 2:
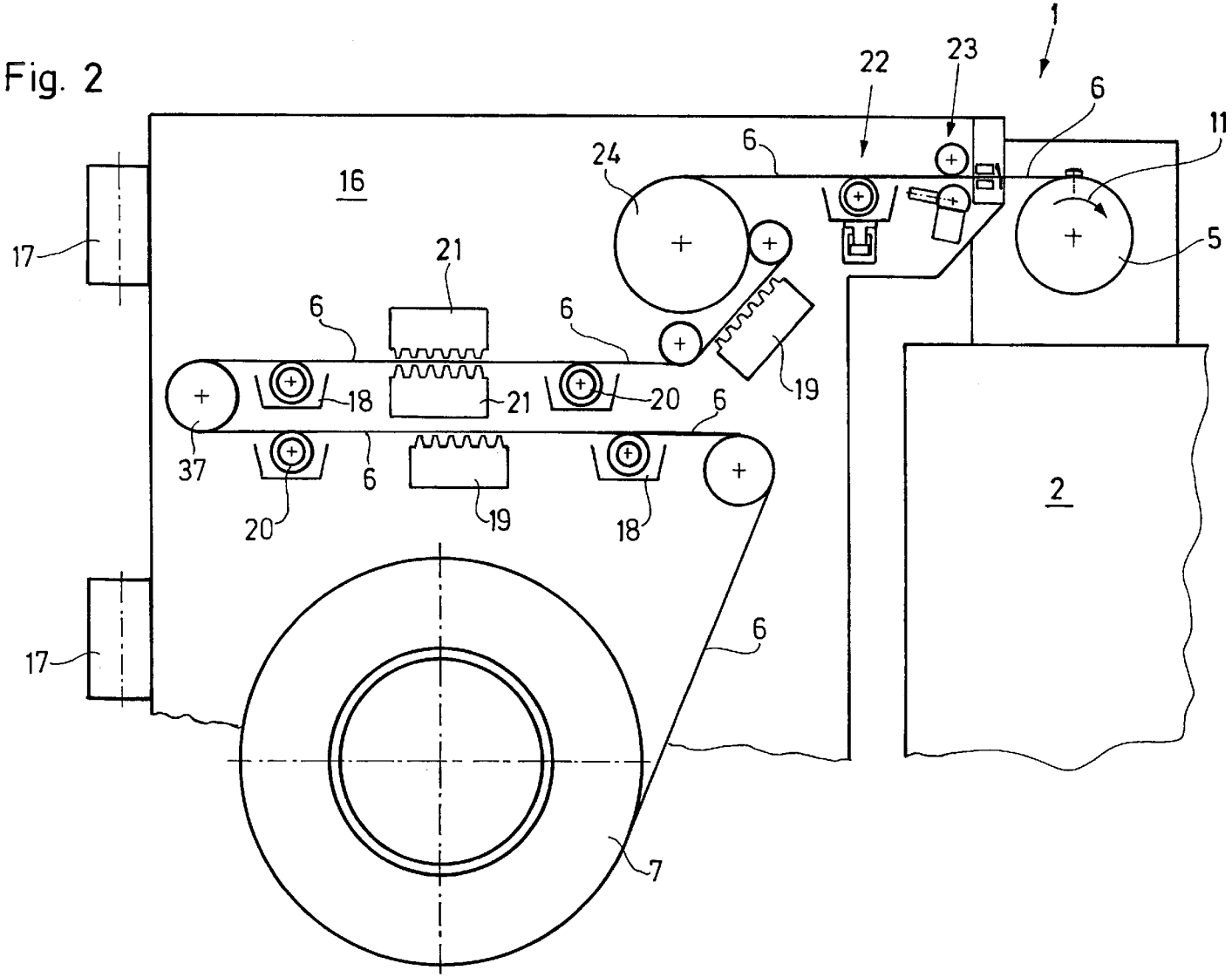
FIG. 2 shows a winding station with integrated winding-material pretreatment.

FIG. 2 shows a winding station for implementing the method of the present invention, in which the pretreatment of the tape material to be wound can take place as well.

Winding station 1 comprises a support wall 16 in which, inter alia, a material spool 7 is rotationally mounted that receives the supply of narrow tape material 6. Narrow tape material 6 is constantly unwound from supply spool 7 and, after a first deflection, runs up onto a material cleaning station 18. There, tape material 6 is cleaned. The cleaning of tape material 6 is necessary to continuously remove dust, grease or other coatings from the surface of slowly unwinding tape 6. This cleaning station 18 initially acts only on one side of tape material 6, which subsequently passes through a first drying station 19, from which it arrives in a primer station 20.

There, depending on the tape material 6 to be processed, a material reinforcing the adhesive capacity can be applied to assure a perfect adhesive bond later. The reason for this is that anaerobic systems can be provided as adhesive. These systems, hardening under the exclusion of air, require the presence of non-ferrous (Ne) ions. However, these ions are lacking in highly alloyed steels (high-grade steels), so that these steels must be pretreated when they are used as the tape material. Such a pretreatment can be done with primers, for instance, or the unwound high-grade steel tape is brushed with copper or brass brushes before the bonding. This can be carried out in an appropriately modified primer station 20 in which, instead of applying material by rolls or brushes, brushes having copper or brass bristles can then be arranged to enrich tape material 6 with sufficient Ne ions.

As can also be inferred from FIG. 2, all the pretreatment stations such as cleaning, drying, conditioning and application of adhesive for the top and bottom sides of tape material 6 are accommodated by the support wall which is supported in a manner allowing a pendulum motion relative to the supporting surface of winding cylinder 5. From the adjusted winding speed and the advance of the support, winding angle $\alpha$ adjusts automatically without presettings being necessary for that purpose. More precisely said, winding angle $\alpha$ adjusts on the basis of the tape tension produced by pull and braking roller 24—and the advance, as well as the rotational speed. For this purpose, an exact adjustment of rotational speed and advance is necessary which, however, is calculable with high accuracy. This represents no difficulty when using a high resolving stepping motor 36 (See FIG. 1) with encoder. The ability of support wall 16 to move in a pendulum motion is provided by suspension mounts 17.

Tape material 6, cleaned and conditioned on its bottom side, is turned by approximately 180 degrees at deflection 37 so that the remaining side of the tape material is also accessible to cleaning and further pretreatment. Cleaning station 18 can also be so designed that, by polarity reversal and slightly etching the surface of tape material 6, a microroughness is produced on the surface so that later, after the application of an anaerobic adhesive at adhesive station 22, improved adhesive effectiveness is attained. After cleaning station 18, tape material 6 passes a second drying station 21, acting on both side of tape material 6, which is adjoined by another pretreatment station 20, whose function was already further described above.

After that, tape material 6 passes a second drying station 19 and, by this time, is conditioned on both sides for the winding-up process. Pull and braking roller 24, adjoining in the path of tape material 6, is looped to approximately 270 degrees, as a result of which tape material 6 is held under pre-tension directly before the application of adhesive at 22. In adhesive station 22, the adhesive is applied to pre-tensioned tape material 6 before it is wound. In addition, provision is made for a tape releasing and clamping station 23 to maintain the pre-tension in tape material 6. Tape material 6 must be clamped temporarily after a single or multilayer sleeve is completed on supporting surface 5, or is being ready-processed by means of trimming device 9, 10.

Figure 3:
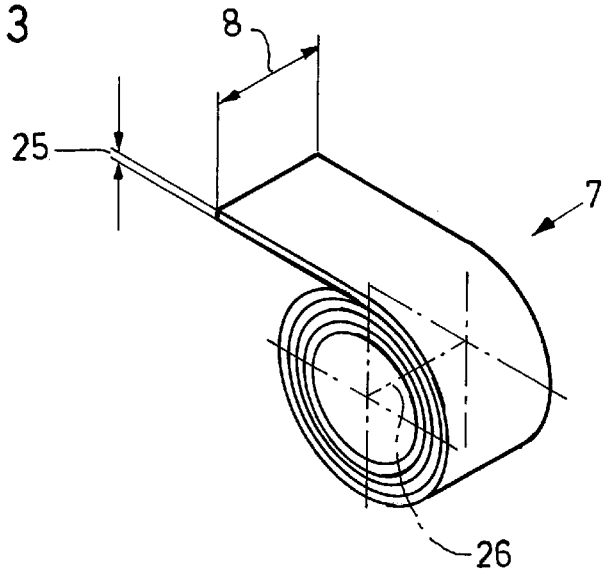
FIG. 3 shows a material coil.

FIG. 3 shows a material coil. A supply of narrow tape material 6—an extremely thinly rolled steel or super-refined steel plate—is wound to a spool 7. Tape material 6 has a material width 8 between 10 and 100 mm, while its thickness 25 is approximately 0.05 mm. Spool 7 is rotatable about its axis 26 and is shown here only schematically.

FIG. 4 shows a base winding composed of a first winding layer. Narrow tape material 6 is wound about a winding cylinder 5 (see FIG. 5) in such a way that a first layer 29 is formed on the surface area of winding cylinder 5. Narrow tape material 6 is inclined at a first inclination 34 by winding angle $\alpha$, so that the individual windings of first layer 29 abut against one another without forming gaps and are free of overlaps. Borders 27, 28 of narrow tape material 6 form abutting surfaces 30 of first layer 29, at which they abut against one another. Therefore, first layer 29, produced using the method according to the invention, is slightly diagonally oriented on winding cylinder 5 and extends over the entire width of winding cylinder 5. The sleeve strip forming per winding revolution, together with the respective previous sleeve strip already wound, form abutting surfaces 30. The exact formation of these abutting surfaces, without gap formation and without material overlap, is of crucial importance for the usability of the wound sleeves. Were gaps to form at abutting surfaces 30, the stiffness of the wound, base sleeve would not be assured. Because of the permeability occurring at the gaps, a build-up of an air cushion for widening the sleeve in the circumferential direction would be realizable only with great difficulty or not at all. An overlapping of the narrow tape material at abutting surfaces 30 would destroy the required accuracy of the sleeve to be manufactured.

Figure 5:
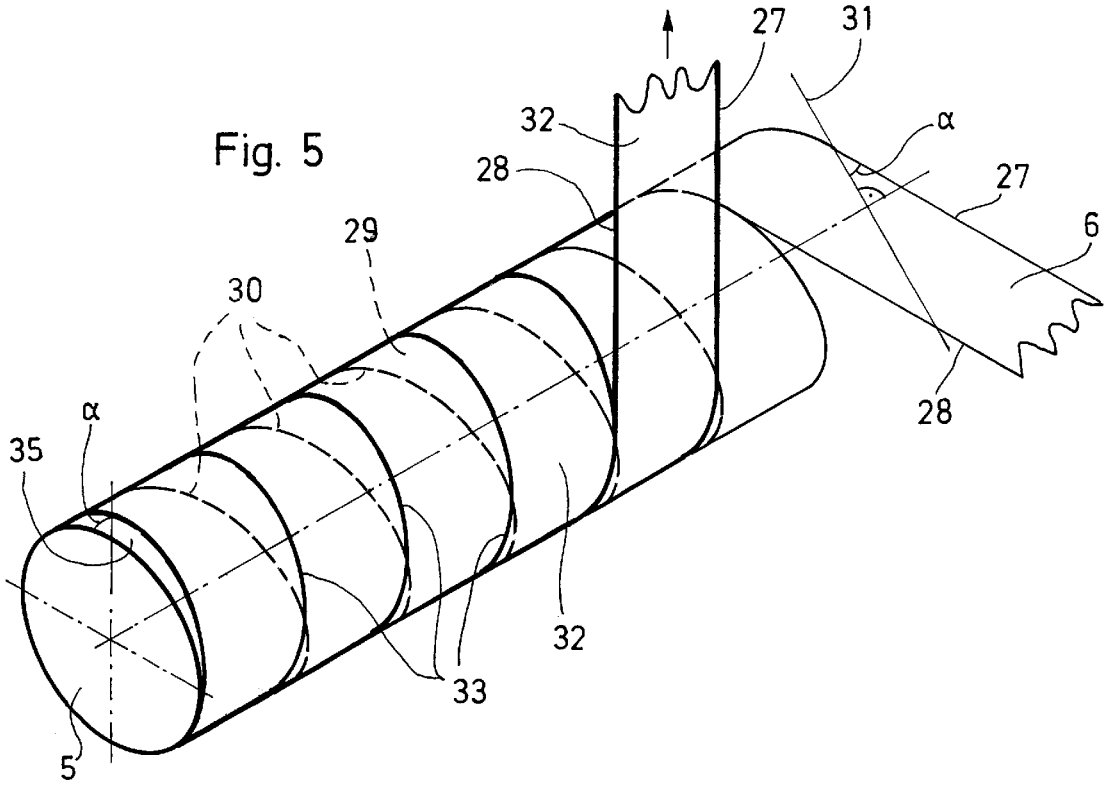
FIG. 5 shows the representation of a winding sequence, given a two-layer winding.

FIG. 5 shows the representation of a winding sequence, given a multilayer winding. First layer 29 of narrow tape material 6, which forms the base layer of the base sleeve, is applied with a first winding angle $\alpha$ in winding direction 11 transverse to normal 31 to the winding-cylinder axis. Borders 27, 28 in each case form aforesaid abutting surfaces 30. If, according to the method of the present invention, narrow tape material 6 has passed an adhesive station 22 beforehand, at which adhesive was applied, then a further layer of narrow tape material 6, provided on one side with adhesive, can be applied on first layer 29. It forms further layer 32 on first layer 29. As FIG. 5 shows, further layer 32 is wound with an incline 35 contrary to the winding of first layer 29. Formed in further layer 32 are abutting surfaces 33 which are likewise gap-free and without overlap. Abutting surfaces 33 cross abutting surfaces 30 of previously applied layer 29, and thus contribute to an increase in stiffness of a multilayer composite construction of the sleeve.

Figure 6:
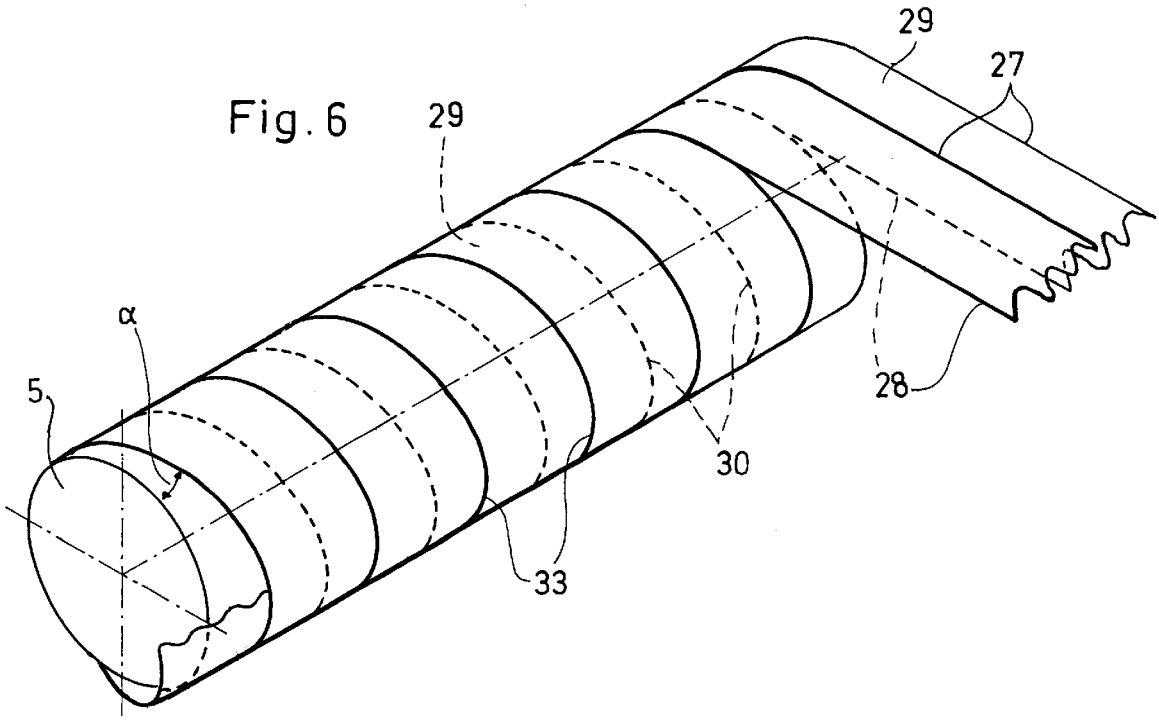
FIG. 6 shows an offset winding of two winding layers.

Instead of the bi-directional winding shown in FIG. 5, a winding method according to FIG. 6 can also be used. Here - for the purpose of illustrating the simplest case—a uniformly broad tape 6 is wound, offset by half the tape material 6 with respect to layer 29 already lying under it. First of all, layer 29 is wound with winding angle $\alpha$ on winding cylinder 5, forming abutting surfaces 30; further layer 32 is subsequently wound in such a way that it runs onto first layer 29 by half the width of tape material 6. Consequently, abutting surfaces 33 resulting during such a winding do not lie over abutting surfaces 30 of first layer 29, but rather are displaced with respect to them by half of narrow tape material 6. This makes it possible to attain a substantially higher rigidity against buckling of multilayer sleeves.

After winding on the cylinder 5 and the setting of the adhesive, the sleeves of course can removed axially from the cylinder 5, if desired, with the aid of air pressure from air holes in the cylinder 5. Either before or after removal from the cylinder 5, the sleeves produced with the method of the present invention may be coated with a continuous and gapless layer of polymeric or plastic material, such as artificial or natural rubber, for use as sleeves in rotary printing presses.

What is claimed is:

1. A method for manufacturing a cylindrical carrier sleeve for a rotary printing press comprising the steps of:

unwinding a material from a material supply the material being a metal strip or tape advancing the material supply;

winding the material onto a supporting surface of a winding cylinder while maintaining tensile stress; and cleaning and conditioning the material and coating the material with an adhesive, the cleaning, conditioning and coating steps occuring after the material is unwound from the material supply and before the material is wound on the supporting surface;

a pendulum support for the material permitting an automatic adjustment of a winding angle $\alpha$ during the advancing step.

2. The method as recited in claim 1 wherein during the cleaning step the material is cleaned continuously.

3. The method as recited in claim 1 wherein the conditioning includes etching a roughness into the material at a cleaning station.

4. The method as recited in claim 1 wherein after the cleaning step, the material passes a first drying station.

5. The method as recited in claim 1 wherein the conditioning step occurs after passing a first drying station.

6. The method as recited in claim 5 wherein the conditioning step includes passing a conditioning station for surface treatment.

7. The method as recited in claim 5 wherein a surface of the material is coated with a primer for improving adhesive capacity.

8. The method as recited in claim 1 wherein trimming devices are allocated to end faces of layers produced from the material.

9. The method as recited in claim 8 wherein cutting tools are provided as the trimming devices.

10. The method as recited in claim 8 wherein lasers are provided as the trimming devices.

11. The method as recited in claim 8 wherein an edge of the layers is simultaneously trimmed and welded all-around using the trimming devices.

12. The method as recited in claim 1 wherein the tensile stress is created by holding the material under pre-tension by looping the material around a pull and braking roller during the winding step.

13. The method as recited in claim 1 wherein the coating step takes place after the conditioning step.

14. The method as recited in claim 13 wherein the adhesive is an anaerobic adhesive.

15. The method as recited in claim 1 wherein the material is a tape material.

16. A method for winding a material onto a supporting surface of a winding cylinder comprising the steps of:

unwinding the material from a material supply;

advancing the material supply;

winding the material onto a supporting surface while maintaining tensile stress; and cleaning and conditioning the material and coating the material with an adhesive, the cleaning, conditioning and coating steps occuring after the material is unwound from the material supply and before the material is wound on the supporting surface, the conditioning step occuring after the material passes a first drying station;

a pendulum support for the material permitting an automatic adjustment of a winding angle $\alpha$ during the advancing step and;

wherein a surface of the material is enriched with non-ferrous ions.

17. The method as recited in claim 16 wherein the non-ferrous ions are applied using brushes in a conditioning station.

18. The method as recited in claim 17 wherein the brushes are made of copper.

19. The method as recited in claim 17 wherein the brushes are made of brass.

20. A method for winding a material onto a supporting surface of a winding cylinder comprising the steps of:

unwinding the material from a material supply;

advancing the material supply;

winding the material onto a supporting surface while maintaining tensile stress; and cleaning and conditioning the material and coating the material with an adhesive, the cleaning, conditioning and coating steps occuring after the material is unwound from the material supply and before the material is wound on the supporting surface;

a pendulum support for the material permitting an automatic adjustment of a winding angle $\alpha$ during the advancing step; and wherein the material is cleaned electrolytically.

21. A method for winding a material onto a supporting surface of a winding cylinder comprising the steps of:

unwinding the material from a material supply;

advancing the material supply;

winding the material onto a supporting surface while maintaining tensile stress; and cleaning and conditioning the material and coating the material with an adhesive, the cleaning, conditioning and coating steps occurring after the material is unwound from the material supply and before the material is wound on the supporting surface, the conditioning step occurring after the material passes a first drying station;

applying non-ferrous ions to the material in a conditioning station through a liquid primer;

a pendulum support for the material permitting an automatic adjustment of a winding angle $\alpha$ during the advancing step; and wherein non-ferrous ions are applied to the material in a conditioning station through a liquid primer.

22. A method for winding a material onto a supporting surface of a winding cylinder comprising the steps of:

unwinding the material from a material supply;

advancing the material supply;

winding the material onto a supporting surface while maintaining tensile stress; and cleaning and conditioning the material and coating the material with an adhesive, the cleaning, conditioning and coating steps occurring after the material is unwound from the material supply and before the material is wound on the supporting surface, the conditioning step occurring after the material passes a first drying station;

conditioning a side of the material and deflecting the material to permit pretreatment of an other side of the material;

a pendulum support for the material permitting an automatic adjustment of a winding angle $\alpha$ during the advancing step; and wherein a side of the material is conditioned and the material is deflected to permit pretreatment of an other side of the material.

* * * * *